US008838416B2

(12) United States Patent
Kuroiwa et al.

(10) Patent No.: US 8,838,416 B2
(45) Date of Patent: Sep. 16, 2014

(54) AIR CONDITIONING SYSTEM DIAGNOSTIC APPARATUS

(75) Inventors: Takeru Kuroiwa, Chiyoda-ku (JP); Masanori Nakata, Chiyoda-ku (JP); Tomoaki Gyota, Chiyoda-ku (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 427 days.

(21) Appl. No.: 13/259,032

(22) PCT Filed: Mar. 11, 2010

(86) PCT No.: PCT/JP2010/001752
§ 371 (c)(1),
(2), (4) Date: Sep. 22, 2011

(87) PCT Pub. No.: WO2010/119609
PCT Pub. Date: Oct. 21, 2010

(65) Prior Publication Data

US 2012/0029874 A1 Feb. 2, 2012

(30) Foreign Application Priority Data

Apr. 13, 2009 (JP) ..... 2009-097286

(51) Int. Cl.

| | |
|---|---|
| ***G06F 15/00*** | (2006.01) |
| ***G01R 13/00*** | (2006.01) |
| ***F25B 49/00*** | (2006.01) |
| *F24F 11/00* | (2006.01) |

(52) U.S. Cl.

CPC ..... *F25B 49/005* (2013.01); *F24F 2011/0091* (2013.01)

USPC ..... 702/183; 700/276; 702/66; 714/26

(58) Field of Classification Search

CPC ..... F25B 49/005; F24F 2011/0091; F24F 11/0086; F24F 2011/0067; F24F 2011/0071; F24F 2011/0072; G06F 11/2257; G06F 19/321; G06F 19/3412

USPC ..... 702/66, 67, 71, 81, 89, 98, 99, 113, 702/116, 119, 130, 132, 138, 183, 184, 702/185; 700/276, 277, 286; 714/26, 724

See application file for complete search history.

(56) References Cited

U.S. PATENT DOCUMENTS 6,609,217 B1 * 8/2003 Bonissone et al. ..... 714/26
7,260,451 B2 * 8/2007 Takai et al. ..... 700/276

FOREIGN PATENT DOCUMENTS

JP 10-019351 A 1/1998
JP 2000-320880 A 11/2000

(Continued)

OTHER PUBLICATIONS

International Search Report (PCT/ISA/210) issued on Jun. 15, 2010, by Japanese Patent Office as the International Searching Authority for International Application No. PCT/JP2010/001752.

(Continued)

*Primary Examiner* — John H Le
(74) *Attorney, Agent, or Firm* — Buchanan Ingersoll & Rooney PC

(57) ABSTRACT

An air conditioning system diagnosis apparatus is obtained in which a refrigerating cycle is automatically analyzed and waveform data in messages flowing in a general-purpose network is acquired and automatically analyzed according to the analysis result of the refrigerating cycle, thereby achieving, with a single apparatus, diagnosis and monitoring of errors in the refrigerating cycle and in the general-purpose network. A trigger output portion creates a trigger on the basis of a waveform analysis condition and the analysis result of a packet received from a message analyzing portion; when receiving the trigger, a waveform input portion reads out waveform data stored in a buffer; waveform analyzing portion notifies a synchronization determining portion of the analysis result of the waveform data; the synchronization determining portion searches for the analysis result of a packet synchronized with the received analysis result of the waveform data.

15 Claims, 8 Drawing Sheets

(56) References Cited

FOREIGN PATENT DOCUMENTS

| | | | |
|---|---|---|---|
| JP | 3475915 | B2 | 12/2003 |
| JP | 2005-044369 | A | 2/2005 |
| JP | 2006-275411 | A | 10/2006 |
| JP | 2008-160356 | A | 7/2008 |
| JP | 2008-249234 | A | 10/2008 |
| JP | 2008-283259 | A | 11/2008 |
| WO | WO 2009/096299 | A1 | 8/2009 |

OTHER PUBLICATIONS

Office Action (Notification of Reasons for Refusal) from Japanese Patent Office issued in corresponding Japanese Patent Application No. 2009-097286 dated Jul. 19, 2011, with an English translation thereof.

Chinese Office Action (Notification of the First Office Action) dated Jul. 11, 2013, issued in corresponding Chinese Application No. 201080016394, and an English Translation of the Office Action (10 pgs.).

* cited by examiner

| TEMPLATE TYPE | PACKET POSITION | REFERENCE VALUE | WEIGHT |
|---|---|---|---|
| NORMAL | 1 | 0xAA | 10 |
| NORMAL | 3 | SAME AS MESSAGE LENGTH | 6 |
| ABNORMAL | 1 | 0xCC | 1 |
| ABNORMAL | AT END | 0x00 TO 0x02 | 3 |
| : | : | : | : |

FIG. 9

| PARAMETER NAME | ABNORMALITY LEVEL |
|---|---|
| Droop | 0.8 |
| Ringing | 1.33 |
| ⋮ | |
| SIGNAL LEVEL | 1.05 |

* VALUES ABOVE ARE JUST EXAMPLES.

AIR CONDITIONING SYSTEM DIAGNOSTIC APPARATUS

TECHNICAL FIELD

The present invention relates to an air conditioning system diagnostic apparatus that retrieves messages flowing in a general-purpose network and analyzes them to monitor the air conditioning system in which a plurality of air conditioners are connected through refrigerant pipes and the general-purpose network.

BACKGROUND ART

In conventional air conditioning systems, error diagnosis or monitoring has been carried out to maintain and continue normal operation.

Possible errors in an air conditioning system include errors in a refrigerating cycle due to defective refrigerant pipes or an incorrect amount of refrigerant as well as network errors in which, for example, the air conditioning system is not correctly controlled by a bit error. It is demanded that if this type of error occurs, the cause and location of the error should be quickly identified and action such as correction should be taken. Therefore, an apparatus that can automatically determine the cause and location of the error is demanded.

Methods of determining the causes and locations of errors may be broadly classified as follows: for refrigerating cycle errors, (1) methods by which measurement values of refrigerant temperature sensors or refrigerant pressure sensors are obtained through a network to detect abnormal values.

For network errors, (2) methods by which waveform data of electric signals flowing in transmission lines is obtained to detect abnormal waveforms.

One proposed apparatus that diagnoses failures and errors in the refrigerating cycle as described above monitors the state of the refrigerating cycle; the apparatus retrieves the settings of sensors or control data such as abnormal signals, and performs diagnosis for failures and errors on the basis of the maximum or minimum value of pressure, temperature, or the like or daily operation trend data (see PTL 1 or 2, for example).

An air conditioning system in which a plurality of air conditioners are connected to a centralized management unit through an Ethernet (registered trademark) or the like has also been proposed (see PTL 3 or 4, for example). A diagnostic unit for the general-purpose network has also been proposed (see PTL 5, for example).

CITATION LIST

Patent Literature

PTL 1: Japanese Patent No. 3475915 (pages 4 and 5, FIG. 4)

PTL 2: Japanese Unexamined Patent Application Publication No. 2008-249234 (pages 15 and 16, FIG. 2)

PTL 3: Japanese Unexamined Patent Application Publication No. 2005-44369 (pages 9 and 10, FIG. 1)

PTL 4: Japanese Unexamined Patent Application Publication No. 2000-320880 (page 3, FIG. 1)

PTL 5: Japanese Unexamined Patent Application Publication No. 2008-160356 (pages 5 and 6, FIG. 1)

SUMMARY OF INVENTION

Technical Problem

In the method of determining the causes and locations of errors in the refrigerating cycle as described in (1) above, however, the causes and locations of errors in the refrigerating cycle can be determined by comparing an obtained measured value with previous know-how or a database, but the method is problematic in that it cannot be determined whether the value of refrigerant temperature or pressure is actually abnormal or the obtained measured value is abnormal due to a sensor failure or a network error such as a bit error in a message.

In conventional failure diagnosis and monitoring, therefore, it is necessary to separately provide an apparatus that diagnoses and monitors failures in the refrigerating cycle and an apparatus that diagnoses and monitors failures in the general-purpose network, preventing the air conditioning system from being efficiently serviced.

In the method of determining network errors as described in (2), physical factors of abnormal messages can be determined by using know-how or a database in which relationships between previous abnormal waveform data and investigation results of the causes of the abnormalities are accumulated. With the human eye, however, it is hard to determine whether the waveform is abnormal at a glance. Another problem is that the amount of sampling data on abnormal waveforms would become huge (if sampling were to be carried out at 1 MHz, for example), so waveforms are also hard to continuously collect.

The present invention addresses the above problems and an object thereof is to obtain an air conditioning system diagnosis apparatus in which a refrigerating cycle is automatically analyzed and waveform data in messages flowing in a general-purpose network is obtained and automatically analyzed according to the analysis result of the refrigerating cycle, by which a single apparatus can perform diagnosis and monitoring of errors in the refrigerating cycle and in the general-purpose network and thereby the efficiency of the maintenance of the air conditioning system is increased.

Solution to Problem

The air conditioning system diagnosis apparatus according to the present invention is characterized by having: message input means for retrieving a message flowing in a general-purpose network in an air conditioning system configured by connecting a plurality of air conditioners, each of which incorporates a refrigerating cycle, through the general-purpose network; message analyzing means for analyzing the content of the message retrieved by the message input means; refrigerating cycle analyzing means for analyzing the state of the refrigerating cycle on the basis of the content of the message (hereinafter referred to as message information) analyzed by the message analyzing means to create refrigerating cycle state information, which is the result of the analysis; waveform input means for retrieving waveform data from the general-purpose network when the message information meets a predetermined condition; waveform analyzing means for making an analysis to determine whether the waveform data retrieved by the waveform input means is abnormal and for creating waveform information, which is the result of the analysis; and storage means for storing the message information, the refrigerating cycle state information, and the waveform information.

Advantageous Effects of Invention

The air conditioning system diagnosis apparatus according to the present invention corresponds a refrigerating cycle analysis result for each refrigerant system with a waveform data analysis result in the refrigerant system so that both the factor and location of an error in the system can be inferred as to whether a failure or an error in the refrigerating cycle or an error in the network happens, enabling action such as correction to be quickly taken and the error to be corrected at an early stage.

Furthermore, since an analysis process is automatically carried out, the cause and location of a system error can be easily identified and action can be taken without specialized knowledge and experience about the refrigerating cycle, communication protocols, and the transmission theory.

BRIEF DESCRIPTION OF DRAWINGS

FIG. 9 illustrates numerization of abnormal degrees of waveform data.

DESCRIPTION OF EMBODIMENTS

Embodiment 1

Structure of the Air Conditioning System Diagnosis Apparatus

Figure 1:
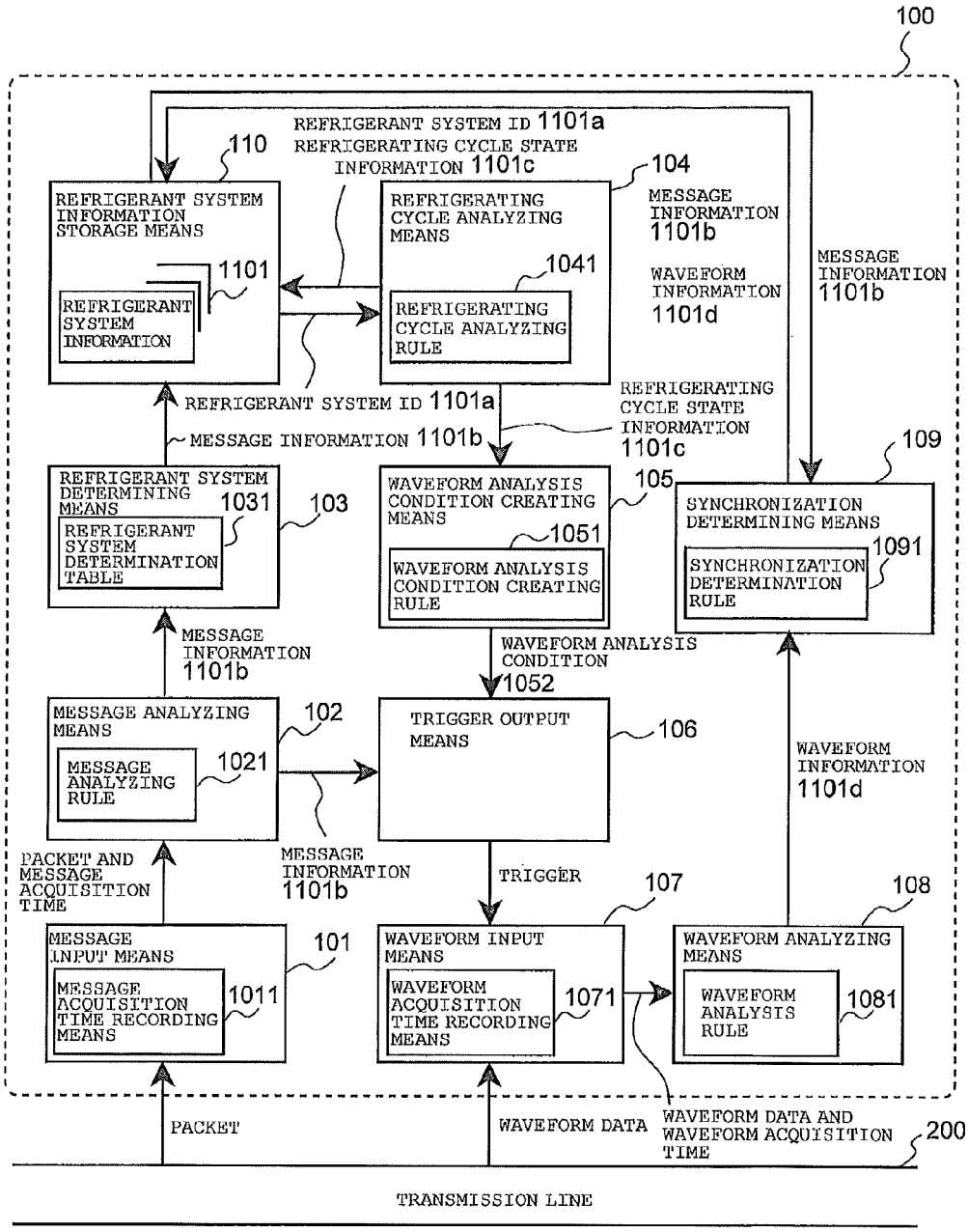
FIG. 1 is a block diagram showing the structure of an air conditioning system diagnosis apparatus according to Embodiment 1 in the present invention.

FIG. 1 is a block diagram showing the structure of an air conditioning system diagnosis apparatus according to Embodiment 1 in the present invention.

The structure of the air conditioning system diagnosis apparatus 100 is constituted by the structures described in (1) to (4) below.

(1) Structure for retrieving a message flowing in a transmission line 200 and analyzing the message (2) Structure for analyzing a refrigerating cycle according to the result in (1) and creating a waveform analysis condition according to the analysis result (3) Structure for retrieving waveform data in the message flowing in the transmission line 200 according to the waveform analysis condition in (2) and the result in (1) and analyzing the message (4) Structure for storing the analysis results in (1), (2), and (3) by corresponding themselves with one another The structures in (1) to (4) are further constituted by components described below.

(1) Structure for Retrieving a Message Flowing in a Transmission Line 200 and Analyzing the Message This structure is constituted by message input means 101 for acquiring a packet flowing in the transmission line 200, message analyzing means 102 for analyzing the packet, and refrigerant system determining means 103 for sorting the result of the analysis according to its related refrigerant system. The message input means 101 has message acquisition time recording means 1011 for attaching a message acquisition time, which represents a time at which the packet was acquired, to the packet. The message analyzing means 102 has a message analyzing rule 1021 used in deriving a protocol for the packet, a transmission source address, and the like. The refrigerant system determining means 103 has a refrigerant system determination table 1031 in which the packet address and the refrigerant system are correlated.

The transmission line 200 is equivalent to the general-purpose network in the present invention, and the packet is equivalent to the message in the present invention.

(2) Structure for Analyzing a Refrigerating Cycle According to the Result in (1) and Creating a Waveform Analysis Condition According to the Analysis Result This structure is constituted by refrigerating cycle analyzing means 104 for analyzing the refrigerating cycle according to message information 1101*b*, which is analyzed by the message analyzing means 102, and by waveform analysis condition creating means 105 for creating a waveform analysis condition 1052, which will be described later, according to the result of the analysis for the refrigerating cycle. The refrigerating cycle analyzing means 104 has a refrigerating cycle analyzing rule 1041 used in determining whether the refrigerating cycle in the refrigerant system in a refrigerant system is abnormal. The waveform analysis condition creating means 105 has a waveform analysis condition creating rule 1051 used in creating the waveform analysis condition 1052.

(3) Structure for Retrieving Waveform Data in the Message Flowing in the Transmission Line 200 According to the Waveform Analysis Condition in (2) and the Result in (1) and Analyzing the Message This structure is constituted by trigger output means 106 for determining whether the message information 1101*b* analyzed by the message analyzing means 102 meets the waveform analysis condition 1052, waveform input means 107 for acquiring waveform data in a message from the transmission line 200, waveform analyzing means 108 for analyzing the waveform data, and synchronization determining means 109 for searching for the message information 1101*b* analyzed by the message analyzing means 102 that is synchronized with the analysis result of the waveform data. The waveform input means 107 has waveform acquisition time recording means 1071 for attaching a waveform acquisition time, which represents a time at which the waveform data was acquired, to the waveform data. The waveform analyzing means 108 has a waveform analysis rule 1081 for the waveform data, the rule being used in deriving the abnormal degree of the waveform, the factor of the abnormality, and other information. The synchronization determining means 109 has a synchronization determination rule 1091 used in searching for the message information 1101*b* analyzed by the message analyzing means 102 that is synchronized with the analysis result of the waveform data.

(4) Structure for Storing the Analysis Results in (1), (2), and (3) by Corresponding Themselves with One Another This structure is constituted by refrigerant system information storage means 110. The refrigerant system information storage means 110 stores one or more refrigerant system information items 1101.

The refrigerant system information storage means 110 is equivalent to the storage means in the present invention.

The message analyzing means 102, refrigerant system determining means 103, refrigerating cycle analyzing means 104, waveform analysis condition creating means 105, trigger output means 106, waveform input means 107, waveform analyzing means 108, or synchronization determining means 109 may have a structure implemented by hardware such as a circuit device or may be formed as software executed by a calculation device such as a microcomputer or CPU.

The message analyzing rule 1021, refrigerant system determination table 1031, refrigerating cycle analyzing rule 1041, waveform analysis condition creating rule 1051, waveform analysis rule 1081, or synchronization determination rule 1091 may have a structure implemented by logic formed in software or by a circuit device equivalent to the logic.

The refrigerant system information storage means 110 can be formed with a writable storage device such as a random access memory (RAM) or hard disk drive (HDD). Separate logical partitions may be formed in the same storage device, and information may be stored in files separately formed in the same storage device.

Next, the operation of the air conditioning system diagnosis apparatus 100 will be described.

(Outline of the Operation of the Air Conditioning System Diagnosis Apparatus)

Figure 2:
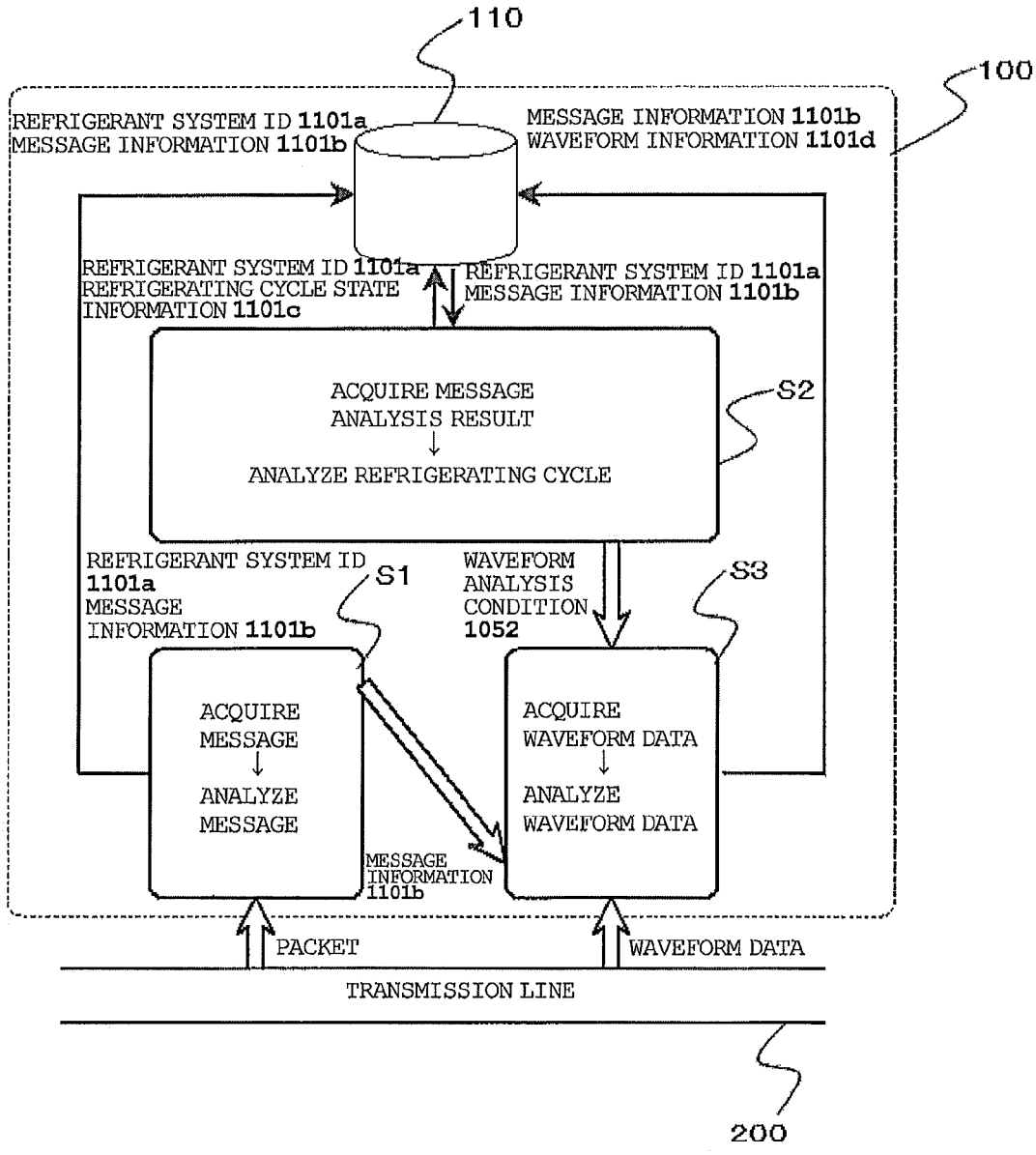
FIG. 2 schematically illustrates processes executed by the air conditioning system diagnosis apparatus according to Embodiment 1 in the present invention.

FIG. 2 schematically illustrates processes executed by the air conditioning system diagnosis apparatus according to Embodiment 1 in the present invention.

The operation of the air conditioning system diagnosis apparatus 100 is broadly classified into steps S1 to S3 described below. The operation of the air conditioning system diagnosis apparatus 100 according to this embodiment will be outlined with reference to steps S1 to S3 in FIG. 2.

(S1) Message Acquiring and Analyzing Step

The message input means 101 acquires a packet flowing in the transmission line 200. Then the message analyzing means 102 analyzes the packet and notifies the refrigerant system determining means 103 and trigger output means 106 of the analysis result of the packet. The refrigerant system determining means 103 sorts and stores the analysis result of the packet according to its related refrigerant system in the refrigerant system information storage means 110.

(S2) Refrigerating Cycle Analyzing Step

The refrigerating cycle analyzing means 104 analyzes the refrigerating cycle on the basis of the analysis result of the packet, which is stored in the refrigerant system information storage means 110, and stores the analysis result of the refrigerating cycle in the refrigerant system information storage means 110. The waveform analysis condition creating means 105 creates the waveform analysis condition 1052, described below, on the basis of the analysis result of the refrigerating cycle.

(S3) Waveform Data Analyzing Step

The trigger output means 106 creates a trigger on the basis of the waveform analysis condition 1052 and the analysis result of the packet received from the message analyzing means 102, and outputs the trigger to the waveform input means 107. Upon receipt of the trigger, the waveform input means 107 reads out waveform data stored in a buffer by using a pre-trigger function, which will be described later, and notifies the waveform analyzing means 108 of the waveform data. The waveform analyzing means 108 analyzes the features of the received waveform data and notifies the synchronization determining means 109 of the analysis result of the waveform data. The synchronization determining means 109 searches for the analysis result of a packet synchronized with the received analysis result of the received waveform data, and stores the analysis result of the waveform data in the refrigerant system information storage means 110 in correlation with the analysis result of the packet.

Next, the operation in steps S1 to S3 in FIG. 2 will be described in detail with reference to FIGS. 3 to 8.

(Message Acquisition and Analysis Performed by the Air Conditioning System Diagnosis Apparatus)

Figure 3:
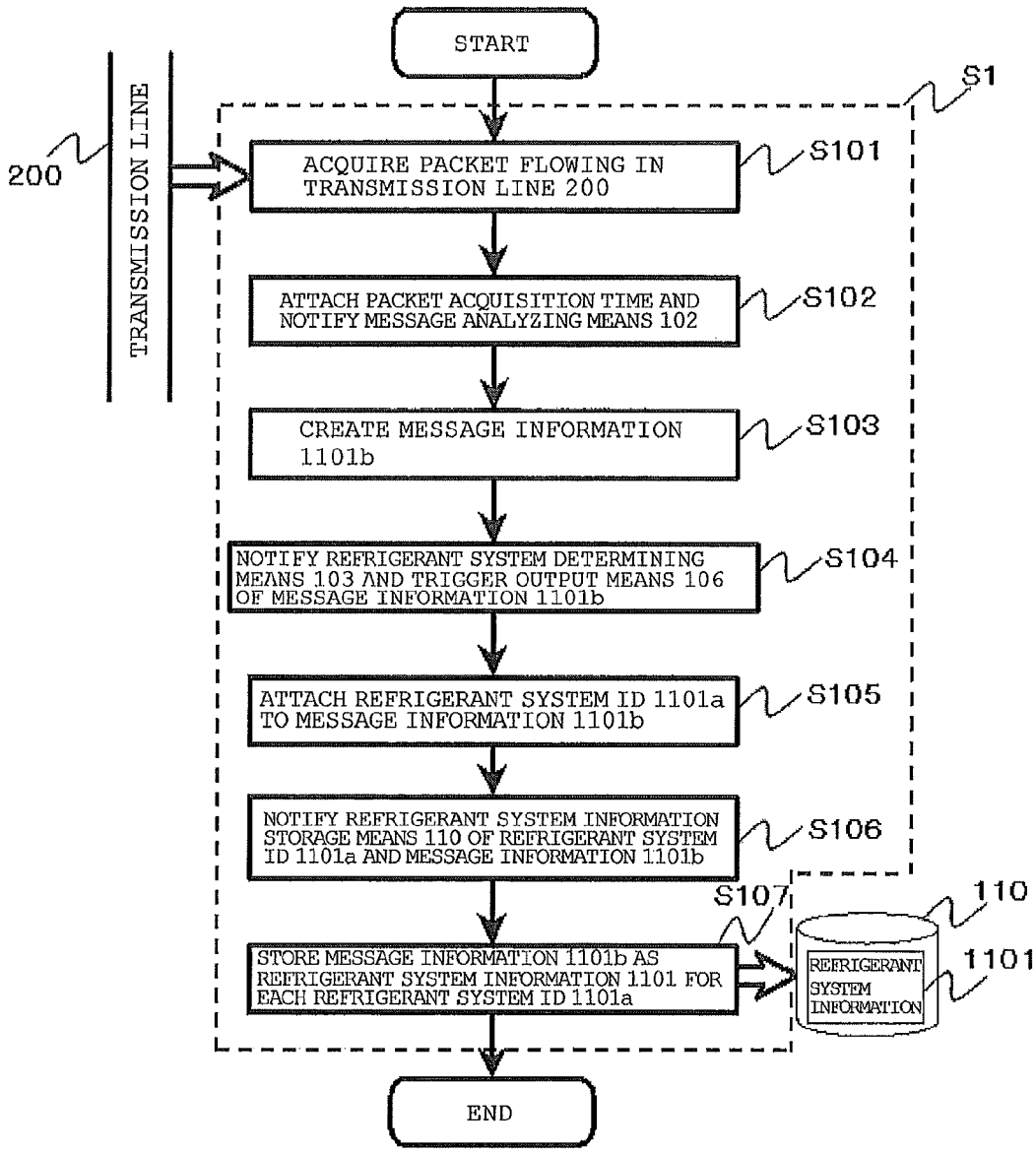
FIG. 3 is a flowchart illustrating details of the operation in step S1 executed by the air conditioning system according to Embodiment 1 in the present invention.
Figure 4:
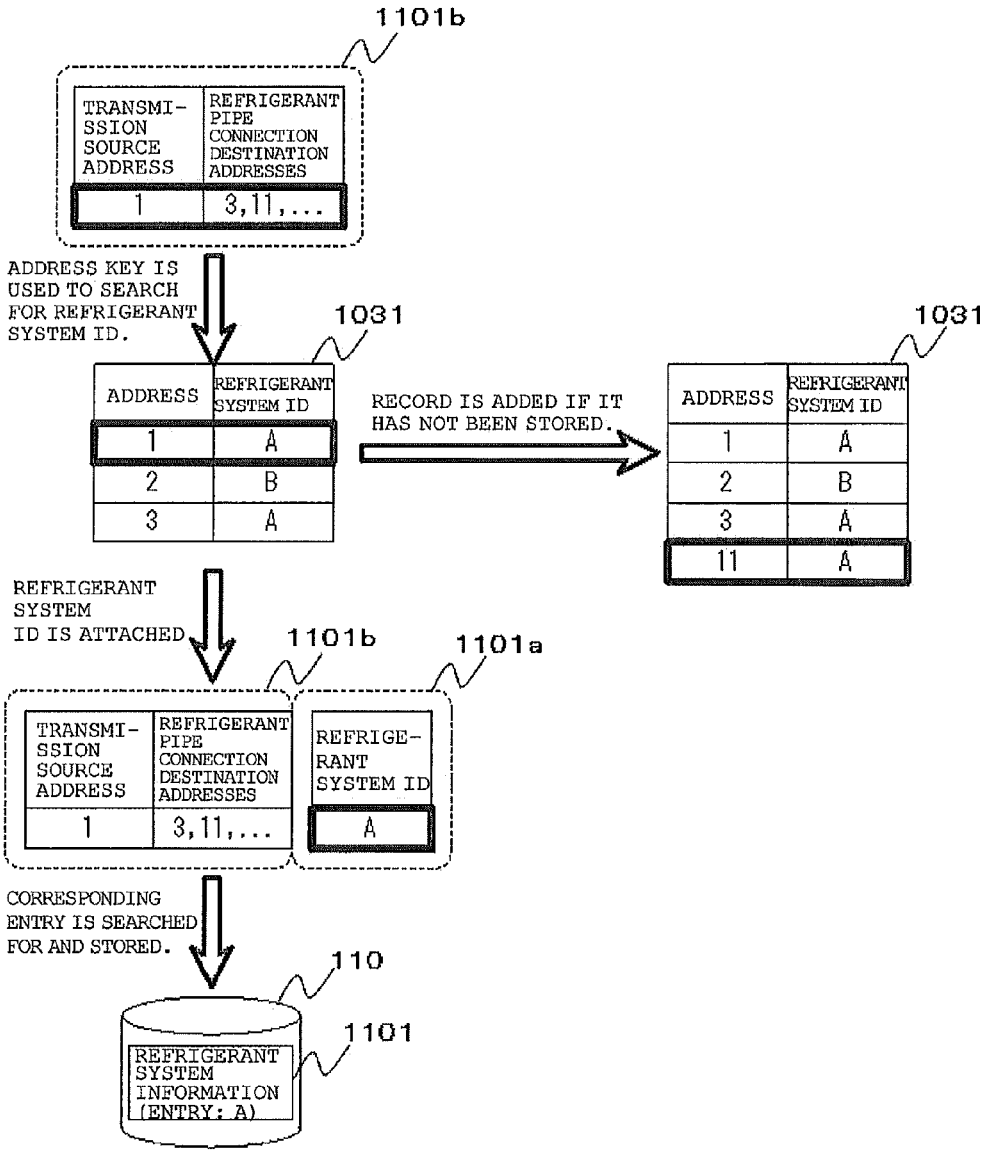
FIG. 4 illustrates a function of sorting and storing message information 1101*b* according to its related refrigerant system in a refrigerant system determination table 1031.

FIG. 3 is a flowchart illustrating details of the operation in step S1 executed by the air conditioning system diagnosis apparatus according to Embodiment 1 in the present invention, and FIG. 4 illustrates a function of sorting and storing message information 1101*b* according to its related refrigerant system in a refrigerant system determination table 1031.

(S101)

The message input means 101 has an interface, which is used for connection to a wired or wireless transmission line 200 in the air conditioning system, through which the message input means 101 successively acquires packets sent or received by a plurality of air conditioners connected to the transmission line 200.

(S102)

The message input means 101 causes the message acquisition time recording means 1011 to acquire a message acquisition time of an acquired packet, the message acquisition time representing a time at which the packet was acquired, attaches the message acquisition time to the packet, and notifies the message analyzing means 102 of the packet to which the message acquisition time has been attached.

The message acquisition time may be an absolute time or a relative time measured from the start of the packet acquisition. The unit time of the message acquisition time is about 1 millisecond, for example.

(S103)

For the packet, to which the message acquisition time has been attached, received from the message input means 101, the message analyzing means 102 successively derives information including the protocol of the packet, the transmission source address, the transmission destination address, a command, the presence or absence of a checksum error, and data (the information will be hereinafter referred to as packet detailed information) according to the message analyzing rule 1021, and creates the message information 1101*b* from the packet detailed information and the packet to which the message acquisition time has been attached.

(S104)

The message analyzing means 102 notifies the refrigerant system determining means 103 and trigger output means 106 of the message information 1101*b*.

(S105)

The refrigerant system determining means 103 successively attaches a refrigerant system ID 1101*a* to the message information 1101*b* received from the message analyzing means 102, by using the refrigerant system determination table 1031. The refrigerant system determination table 1031 is a table that stores each set of an address and a refrigerant system ID 1101*a* as a record so that a refrigerant system to which a refrigerant system belongs can be determined from the message information 1101*b*. As shown in FIG. 4, for example, the message information 1101*b* includes an address and refrigerant pipe connection destination addresses, and the refrigerant system determining means 103 acquires the refrigerant system ID 1101*a*, from the refrigerant system determination table 1031, as a set with the transmission source address or the refrigerant pipe connection destination addresses included in the message information 1101*b* received from the message analyzing means 102, and attaches the acquired ID to the message information 1101*b*.

If a part of the transmission source address and refrigerant pipe connection destination addresses, which are included in the received message information 1101*b*, is not stored in the refrigerant system determination table 1031, the refrigerant system determining means 103 makes the refrigerant system ID 1101*a* corresponding to an already stored address and the non-stored transmission source address or each of the non-stored refrigerant pipe connection destination addresses as a set and stores the set in the refrigerant system determination table 1031 as a new record. If none of the transmission source address and refrigerant pipe connection destination addresses, which are included in the received message information 1101*b*, is stored in the refrigerant system determination table 1031, the refrigerant system determining means 103 creates a new refrigerant system ID 1101*a* and makes it and the non-stored transmission source address or each of the non-stored refrigerant pipe connection destination addresses as a set and stores the set in the refrigerant system determination table 1031 as a new record.

The refrigerant system ID 1101*a* may be a serial number or the address of an outdoor unit belonging to the refrigerant system. In the latter case, the message information 1101*b* includes information with which the type of the air conditioner can be identified.

(S106)

The refrigerant system determining means 103 notifies the refrigerant system information storage means 110 of the message information 1101*b* to which the refrigerant system ID 1101*a* has been attached.

(S107)

The refrigerant system information storage means 110 stores the message information 1101*b* as the refrigerant system information 1101 for each refrigerant system ID 1101*a*. The refrigerant system information storage means 110 adds the message information 1101*b* to the refrigerant system information 1101 corresponding to the received refrigerant system ID 1101*a* each time the refrigerant system determining means 103 notifies the refrigerant system information storage means 110 of the message information 1101*b* to which the refrigerant system ID 1101*a* has been attached.

(Analytical Operation of the Refrigerating Cycle of the Air Conditioning System Diagnosis Apparatus)

Figure 5:
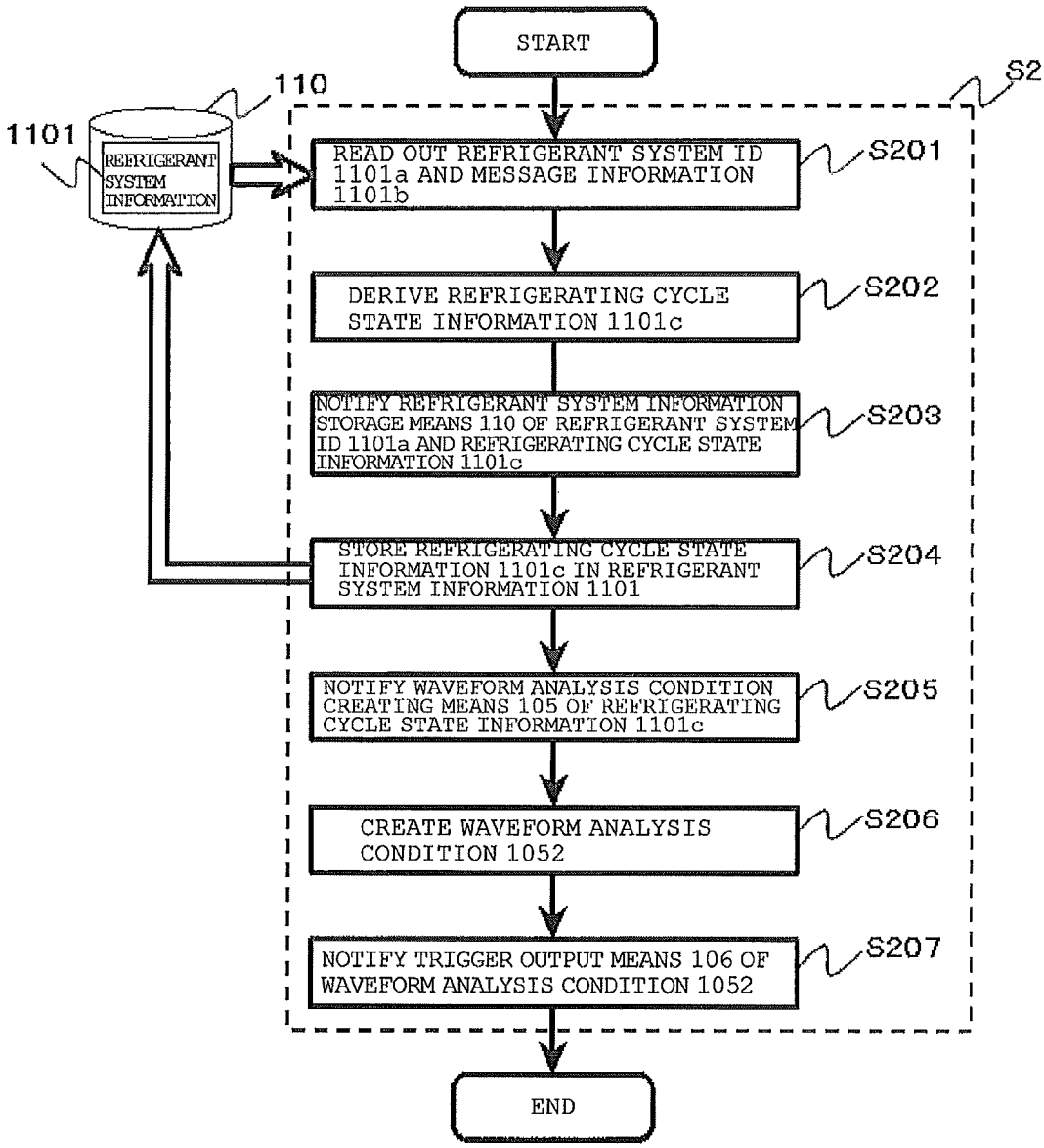
FIG. 5 is a flowchart illustrating details of the operation in step S2 executed by the air conditioning system according to Embodiment 1 in the present invention.
Figures 6, 7:
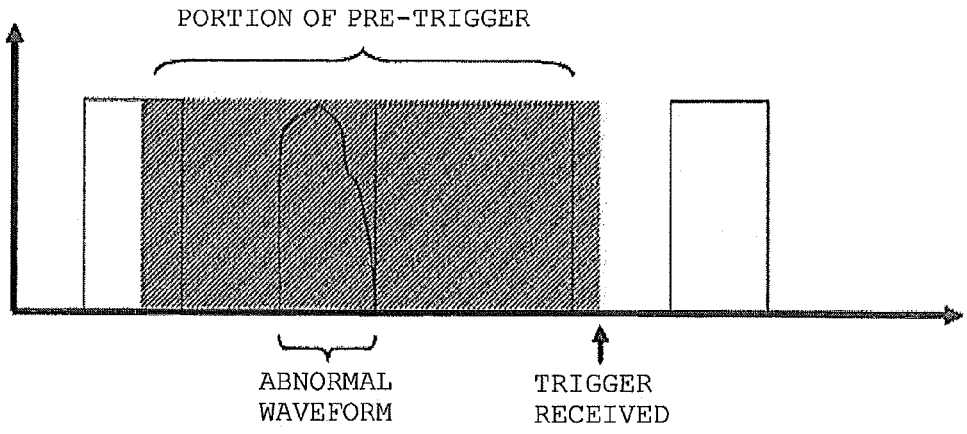
FIG. 6 illustrates normal templates and abnormal templates used to derive similarities to the message information 1101*b*.
FIG. 7 illustrates a pre-trigger function of waveform input means 107.

FIG. 5 is a flowchart illustrating details of the operation in step S2 of the air conditioning system diagnosis apparatus according to Embodiment 1 of the present invention, and FIG. 6 illustrates normal templates and abnormal templates used to derive similarities with the message information 1101*b*.

(S201)

The refrigerating cycle analyzing means 104 successively reads out and acquires the refrigerant system ID 1101*a* stored in the refrigerant system information storage means 110 as well as the message information 1101*b* corresponding to the refrigerant system ID 1101*a*.

(S202)

For the acquired message information 1101*b*, the refrigerating cycle analyzing means 104 successively derives refrigerating cycle state information 1101*c*, which indicates an excess or insufficiency of the amount of refrigerant, a failure of a refrigerant control valve, and the like, according to the refrigerating cycle analyzing rule 1041.

The refrigerating cycle analyzing rule 1041 is a rule used in determining whether the refrigerating cycle in the air conditioner corresponding to a refrigerant system is abnormal. For example, the acquired message information 1101*b* may include the value of a refrigerant temperature sensor or refrigerant pressure sensor as the packet detailed information, and the refrigerating cycle analyzing rule 1041 may include an abnormality threshold; if the value of the refrigerant temperature sensor or refrigerant pressure sensor exceeds the abnormality threshold, then the refrigerating cycle state information 1101*c* may be determined as indicating an abnormality.

Alternatively, the refrigerating cycle analyzing rule 1041 may include normal templates and abnormal templates, and the refrigerating cycle analyzing means 104 may derive similarities of the normal templates and abnormal templates to the acquired message information 1101*b*; if a similarity with an abnormal template is high, then the refrigerating cycle analyzing means 104 may determine that the refrigerating cycle state information 1101*c* has an abnormality.

For example, as shown in FIG. 6, the above similarity is derived by the method described below. The refrigerating cycle analyzing means 104 is assumed to have normal templates 10411 and 10412, abnormal templates 10413 and 10414, and the like as the above normal templates. Each template includes a template type, which indicates that the template is a normal template or an abnormal template, a packet position indicating the position of a packet for which to make a determination, a reference value in the determination, and a weight added when a determination condition is met. At this time, the refrigerating cycle analyzing means 104 extracts packets corresponding to the packet position included in the templates from the packets included in the acquired message information 1101*b*, and determines whether the value of each of the extracted packets is the same as the reference value, falls within the range indicated by the reference values, is greater than or equal to the reference value, or is smaller than or equal to the reference value. If the template meets the determination condition and its template type is the normal template, the value of Its weight is added as the similarity of the normal template. If the template type is the abnormal template, the value of its weight is added as the similarity of the abnormal template. A determination is then made for the refrigerating cycle state information 1101*c* according to the obtained similarity of the normal template and the obtained similarity of the abnormal template. If, for example, the similarity of the abnormal template is greater than or equal to a predetermined threshold or the similarity of the abnormal template is greater than the similarity of the normal template, the refrigerating cycle state information 1101*c* is determined as indicating an abnormality. The templates described above are just examples, and the structure of each template and the method of deriving the similarity on the basis of each template are not limited to the structure and method described above.

Alternatively, the refrigerating cycle analyzing rule 1041 may have a determination time span, and the refrigerating cycle analyzing means 104 may use the message acquisition time included in each acquired message information 1101*b* to derive a logical product or logical sum of determination results, described above, for all message information items 1101*b* included in the determination time span and to create the refrigerating cycle state information 1101*c*.

(S203)

The refrigerating cycle analyzing means 104 notifies the refrigerant system information storage means 110 of the refrigerant system ID 1101*a* and refrigerating cycle state information 1101*c*.

(S204)

The refrigerant system information storage means 110 stores the refrigerating cycle state information 1101*c* for each refrigerant system ID 1101*a* received for the refrigerant system information 1101. Each time the refrigerant system information storage means 110 receives the refrigerant system ID 1101*a* and refrigerating cycle state information 1101*c* from the refrigerating cycle analyzing means 104, the refrigerant system information storage means 110 adds the refrigerating cycle state information 1101*c* to the refrigerant system information 1101 corresponding to the received refrigerant system ID 1101*a* and stores the addition result.

(S205)

The refrigerating cycle analyzing means 104 also notifies the waveform analysis condition creating means 105 of the refrigerating cycle state information 1101*c*.

(S206)

The waveform analysis condition creating means 105 successively creates the waveform analysis condition 1052 from the refrigerating cycle state information 1101*c* received from the refrigerating cycle analyzing means 104, according to the waveform analysis condition creating rule 1051.

The waveform analysis condition 1052 is a condition used in identifying a message for which waveform data is to be analyzed. The content of the condition may be, for example, that "there is a checksum error", "the transmission source address is the specified value", or the logical product or logical sum of the above conditions.

The content of the waveform analysis condition creating rule 1051 may be, for example that "the waveform analysis condition 1052 stipulating that the transmission source address or transmission destination address is the specified value is created by using, as a specified value, an address included in the refrigerant system for which the amount of refrigerant was determined to be too much", "the waveform analysis condition 1052 stipulating that the transmission source address or transmission destination address is the specified value and that there is a checksum error is created by using, as a specified value, an address included in the refrigerant system for which the value of the refrigerant pressure was determined to be abnormal", or the logical product or logical sum of the above conditions. When the content of the waveform analysis condition creating rule 1051 is set as described above, the analysis result of the refrigerating cycle and the analysis result of the waveform data, described later, can be correlated, and thereby it is possible to specifically identify whether the cause of an air conditioning system error is a refrigerating cycle error or a network error. Furthermore, the refrigerating cycle analyzing means 104 may have attached message acquisition times described above to the refrigerating cycle state information 1101*c*, the waveform analysis condition creating means 105 may extract, from the attached message acquisition times, a time span during which specific refrigerating cycle state information 1101*c* indicating an abnormality, a significant change in the refrigerating cycle sate, or the like is frequently generated, and the waveform analysis condition creating rule 1051 may be that "the waveform analysis condition 1052 stipulating, for the time span during which the specific refrigerating cycle state information 1101*c* is frequency generated, that the transmission source address is the specified value is created by using, as a specified value, an address included in the corresponding refrigerant system" or "the waveform analysis condition 1052 stipulating, for the time span during which the specific refrigerating cycle state information 1101*c* is frequency generated, that the message information is the message information 1101*b* having a message acquisition time included in the time span".

When the content of the waveform analysis condition creating rule 1051 is set as described above, it is possible to easily identify an air conditioning schedule problem, periodic communication noise from the outside of the system, or another cause of an air conditioning system error depending on the time span.

(S207)

The waveform analysis condition creating means 105 notifies the trigger output means 106 of the generated waveform analysis condition 1052.

(Operation of the Pre-Trigger Function of the Waveform Input Means 107)

FIG. 7 illustrates a pre-trigger function of the waveform input means 107.

The pre-trigger function is a function of acquiring previous waveform data from the transmission line 200 and accumulating it in a buffer having a predetermined capacity in advance before the waveform input means 107 receives a trigger, which is a sign of the start of waveform data acquisition, from the trigger output means 106, and of acquiring the previous waveform data accumulated in the buffer when a trigger is received from the trigger output means 106. If an abnormality occurs in the waveform data, the abnormality appears as a packet abnormality, so the trigger output means 106 generates a trigger on the basis of the abnormality as explained in step S3 in FIG. 2. After receiving the trigger, the waveform input means 107 may start to acquire waveform data from the transmission line 200, but the waveform abnormality may have disappeared when the waveform data acquisition starts, as shown in FIG. 6, in which case abnormal waveform data cannot be obtained even when waveform data is acquired from that time, and the cause of the error cannot by analyzed.

To address this type of problem, the waveform input means 107 has the pre-trigger function described above, with which the waveform input means 107 constantly acquires and accumulates waveform data within the range of the buffer capacity, and starts to acquire the waveform data accumulated in the buffer upon receipt of a trigger from the trigger output means 106. After all the waveform data accumulated in the buffer has been acquired, waveform data can be acquired directly from the transmission line 200.

Since this pre-trigger function can be used to acquire previous waveform data that was acquired before the trigger output means 106 outputs a trigger, even if packet acquisition by the message input means 101 and waveform data acquisition by the waveform input means 107 are asynchronously performed, the acquired packets and waveform data can be correlated later.

(Analytical Operation on Waveform Data by the Air Conditioning System Diagnosis Apparatus)

Figure 8:
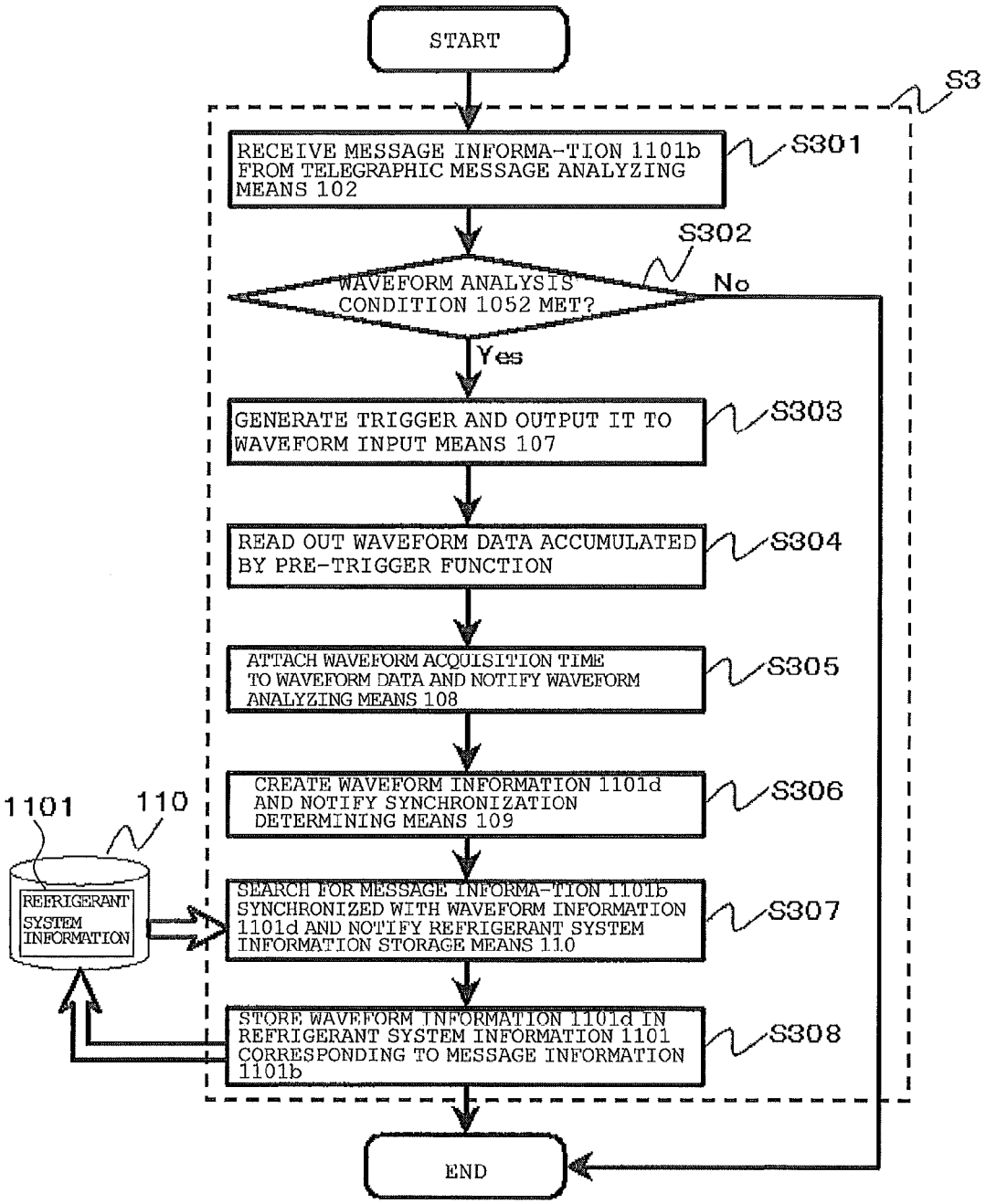
FIG. 8 is a flowchart illustrating details of the operation in step S3 executed by the air conditioning system according to Embodiment 1 in the present invention.

FIG. 8 is a flowchart illustrating details of the operation in step S3 executed by the air conditioning system diagnosis apparatus according to Embodiment 1 in the present invention, and FIG. 9 illustrates numerization of abnormal degree of waveform data.

(S301)

The trigger output means 106 receives message information 1101*b* from the message analyzing means 102.

(S302)

The trigger output means 106 determines whether the received message information 1101*b* meets the waveform analysis condition 1052 received from the waveform analysis condition creating means 105. If the determination result is that the waveform analysis condition 1052 is met, the process proceeds to step S303. If the condition is not met, the process is terminated.

(S303)

The trigger output means 106 generates a trigger and outputs it to the waveform input means 107.

(S304)

The waveform input means 107 has an interface, which is used for connection to the transmission line 200, through which the waveform input means 107 successively acquires waveform data in messages sent or received by the plurality of air conditioners connected to the transmission line 200 at a sampling frequency of, for example, 1 MHz and stores the acquired waveform data in the buffer provided for the pre-trigger function. Upon receipt of a trigger from the trigger output means 106, the waveform input means 107 acquires waveform data accumulated in the buffer provided for the pre-trigger function. After acquiring all the waveform data stored in the buffer, the waveform input means 107 acquires waveform data directly from the transmission line 200.

Although a case in which the pre-trigger function is used has been described above, this is not a limitation; the waveform input means 107 may be structured so that upon receipt of a trigger from the trigger output means 106, the waveform input means 107 acquires waveform data directly from the transmission line 200. Alternatively, the waveform input means 107 may be structured so that it can select whether to use the pre-trigger function.

(S305)

The waveform input means 107 causes the waveform acquisition time recording means 1071 to acquire the waveform acquisition time of the acquired waveform data, the waveform acquisition time representing a time at which the waveform data was acquired, and to attach the waveform acquisition time to the waveform data. Then, the waveform input means 107 notifies the waveform analyzing means 108 of the waveform data to which the waveform acquisition time has been attached.

The waveform acquisition time may be an absolute time or a relative time measured from the start of the waveform data acquisition. The unit time of the waveform acquisition time is about 1 millisecond, for example.

(S306)

For the waveform data received from the waveform input means 107, the waveform analyzing means 108 successively derives the abnormality degree of the waveform data or information about the cause of the abnormality or the like (hereinafter referred to as waveform data detailed information) according to the waveform analysis rule 1081, creates waveform information 1101*d* by combining waveform data detailed information and the waveform data to which the waveform acquisition time has been attached, and notifies the synchronization determining means 109 of the waveform information 1101*d*.

The waveform analysis rule 1081 is a rule to put the abnormality degree of the waveform data to be transmitted into a numerical value, for each parameter that characterizes the waveform data, as shown in FIG. 8, exemplary parameters of this type being the signal level of the waveform data, Droop, and Ringing.

(S307)

The synchronization determining means 109 searches for message information 1101*b* that is synchronized with the received waveform information 1101*d* among the message information 1101*b* stored in the refrigerant system information storage means 110, according to the synchronization determination rule 1091, attaches the waveform information 1101*d* to the synchronized message information 1101*b*, and notifies the refrigerant system information storage means 110 of the message information 1101*b* to which the waveform information 1101*d* has been attached.

The content of the synchronization determination in the synchronization determination rule 1091 may be set as described in (1) to (4) below, for example.

(1) If the difference between the message acquisition time and the waveform acquisition time is smaller than or equal to a threshold, these times are regarded as being synchronized. Since this determination standard enables a synchronization determination to be easily made, a calculation load can be lessened.

(2) If the degree of a match between a waveform obtained by converting the packet included in the message information 1101*b* to analog form and the waveform data included in the waveform information 1101*d* is larger than or equal to a predetermined threshold, the waveform and waveform data can be regarded as being synchronized. In the calculation of the match degree, any calculation method, such as a method based on a square mean, can be used. The determination standard enables a match determination to be made more strictly than (1), increasing the precision of analysis.

(3) If the degree of a match between a signal obtained by packetizing the waveform data included in the waveform information 1101*d* and the packet included in the message information 1101*b* is larger than or equal to a predetermined threshold, the signal and packet are regarded as being synchronized. This determination standard also enables a match determination to be made more strictly than (1), increasing the precision of analysis.

(4) A synchronization determination is made by using the logical product or logical sum of the conditions in (1) to (3) above.

(S308)

Each time the refrigerant system information storage means 110 receives, from the synchronization determining means 109, the message information 1101*b* to which the waveform information 1101*d* has been attached, the refrigerant system information storage means 110 adds the waveform information to the 1101*d* to the refrigerant system information 1101 corresponding to the received message information 1101*b* and stores the addition result. When the message information 1101*b* and waveform information 1101*d* are correlated as describe above, a communication error generated in the network can be easily comprehended and the cause of the error can be quickly identified.

After the waveform information 1101*d* has been derived by the waveform analyzing means 108, the waveform information 1101*d* may be correlated with the message information 1101*b* synchronized with the waveform information 1101*d* or may be correlated with the refrigerating cycle state information 1101*c* about the refrigerant system to which the message information 1101*b* belongs, after which the waveform information 1101*d* may be output to a display or the like together with the correlation relation.

Output means such as a display may be provided on, for example, an external surface of the cabinet of the main body of the air conditioning system diagnosis apparatus 100, as necessary. However, this is not a limitation; the waveform information 1101*d*, the message information 1101*b* synchronized with it, and the refrigerating cycle state information 1101*c* about the refrigerant system to which the message information 1101*b* belongs may be output to, for example, a computer, and an analysis result may be viewed on the screen of the computer.

Advantageous Effect of Embodiment 1

As described above for the structure and operation, corresponding relation between a refrigerating cycle analysis result for each refrigerant system and a waveform data analysis result in the refrigerant system is displayed on, for example, a screen, so both the factor and location of an error in the system can be inferred as to whether the error is a failure or an error in the refrigerating cycle or an error in the network, enabling action such as correction to be quickly taken and the error to be corrected at an early stage.

Furthermore, since an analysis process is automatically carried out, the cause and location of a system error can be easily identified and action can taken without specialized knowledge and experience about the refrigerating cycle, communication protocols, and the transmission theory.

In addition, since a trigger is output according to the analysis result of the packet before acquisition of waveform data starts, the capacity of the refrigerant system information storage means 110 can be saved; the risk that some waveform data is not retrieved due to a difference in time between packet acquisition and waveform acquisition can be eliminated by the pre-trigger function of the waveform input means 107.

Embodiment 2

This embodiment will be described mainly for differences from the structure and operation in Embodiment 1.

Although, in Embodiment 1, the message analyzing rule 1021 and waveform analysis condition 1052 have been configured in a fixed manner, they can be configured so as to be user-settable. However, it is complicated for the user to set individual communication protocols and the like, so the message analyzing rule 1021 and waveform analysis condition 1052 are preferably configured as described below.

(1) Message Analyzing Rule 1021

Choices for protocols to be analyzed are stored in any one of the storage means in the air conditioning system diagnosis apparatus 100 in advance, and a screen for selection is provided for the user so that the user selects a protocol the user wants to analyze. Protocols that can be analyzed include basic protocols such as TCP/IP and application-layer protocols such as SMTP and HTTP; when the network is intended for facility unit management, dedicated protocols such as BACnet and LON are also included.

As described above, when protocols to be analyzed are specified in advance, it can be easily determined whether there is a checksum error or what part in the packet is the transmission source address, enabling the packet to be easily analyzed.

(2) Waveform Analysis Condition 1052

Choices such as "there is a checksum error" and "the transmission source address is the specified value" described in Embodiment 1 are stored in any one of the storage means in the air conditioning system diagnosis apparatus 100 in advance as the waveform analysis condition 1052, and a screen for selection is provided for the user so that the user selects the waveform analysis condition 1052.

When the waveform analysis condition is specified in advance as described above, the message information 1101*b* that meets the waveform analysis condition 1052 selected by the user can be extracted, so the presence or absence of the cause and location of an error can be easily determined.

Although, in this embodiment, the message analyzing rule 1021 and waveform analysis condition 1052 are set so that they are selected by the user, this is not a limitation; choices for the refrigerating cycle analyzing rule 1041, waveform analysis rule 1081, or synchronization determination rule 1091 may be stored in any one of the storage means in the air conditioning system diagnosis apparatus 100 in advance, and a screen for selection may be provided for the user so that the user selects a protocol the user wants to analyze. In this case as well, the presence or absence of the cause and location of an error can be easily determined, and system maintenance can be more efficiently carried out.

INDUSTRIAL APPLICABILITY

Examples of using the present invention include an operation abnormality analysis tool for devices in a facility management system, in a building, that includes air conditioners and lighting fixtures. Not only the output values of refrigerant temperature sensors, room temperature sensors, refrigerant pressure sensors, and other sensors attached to the air conditioners are analyzed, but also the communication system can be analyzed, so problems such as, for example, aged deterioration of air conditioners can be detected at an early stage and action can be taken.

REFERENCE SIGNS LIST

100 air conditioning system diagnosis apparatus, 101 message input means, 102 message analyzing means, 103 refrigerant system determining means, 104 refrigerating cycle analyzing means, 105 waveform analysis condition creating means, 106 trigger output means, 107 waveform input means, 108 waveform analyzing means, 109 synchronization determining means, 110 refrigerant system information storage means, 200 transmission line, 1011 message acquisition time recording means, 1021 message analyzing rule, 1031 refrigerant system determination table, 1041 refrigerating cycle analyzing rule, 1051 waveform analysis condition creating rule, 1052 waveform analysis condition, 1071 waveform acquisition time recording means, 1081 waveform analysis rule, 1091 synchronization determination rule, 1101 refrigerant system information, 1101*a* refrigerant system ID, 1101*b* message information, 1101*c* refrigerating cycle state information, 1101*d* waveform information, 10411, 10412 normal template, 10413, 10414 abnormal template

The invention claimed is:

1. An air conditioning system diagnosis apparatus, comprising:

message input means for retrieving a message flowing in a general-purpose network, in an air conditioning system configured by connecting a plurality of air conditioners, each of which incorporates a refrigerating cycle, through said general-purpose network;

message analyzing means for analyzing the content of said message retrieved by said message input means;

refrigerating cycle analyzing means for analyzing the state of said refrigerating cycle on the basis of message information, which is the content of said message analyzed by said message analyzing means, to create refrigerating cycle state information, which is the result of the analysis;

waveform input means for retrieving waveform data from said general-purpose network;

waveform analyzing means for analyzing to determine whether said waveform data retrieved by said waveform input means is abnormal or not to create waveform information, which is the result of the analysis;

storage means for storing said message information, said refrigerating cycle state information, and said waveform information;

trigger output means that receives said message information from said message analyzing means and outputs a trigger to said waveform input means when said message information meets a waveform analysis condition; and waveform analysis condition creating means for creating said waveform analysis condition according to said refrigerating cycle state information, wherein when receiving said trigger, said waveform input means starts to retrieve said waveform data from said general-purpose network, said waveform analysis condition creating means notifies said waveform analysis condition to said trigger output means, said refrigerating cycle analyzing means extracts a time span having a high frequency abnormality occurrence in said refrigerating cycle, and includes the time span in said refrigerating cycle state information, and said waveform analysis condition creating means creates said waveform analysis condition that said message information is obtained according to said message retrieved in said time span by said message analyzing means.

2. An air conditioning system diagnosis apparatus, comprising:

message input means for retrieving a message flowing in a general-purpose network, in an air conditioning system configured by connecting a plurality of air conditioners, each of which incorporates a refrigerating cycle, through said general-purpose network;

message analyzing means for analyzing the content of said message retrieved by said message input means;

refrigerating cycle analyzing means for analyzing the state of said refrigerating cycle on the basis of message information, which is the content of said message analyzed by said message analyzing means, to create refrigerating cycle state information, which is the result of the analysis;

waveform input means for retrieving waveform data from said general-purpose network;

waveform analyzing means for analyzing to determine whether said waveform data retrieved by said waveform input means is abnormal or not to create waveform information, which is the result of the analysis;

storage means for storing said message information, said refrigerating cycle state information, and said waveform information;

trigger output means that receives said message information from said message analyzing means and outputs a trigger to said waveform input means when said message information meets a waveform analysis condition; and waveform analysis condition creating means for creating said waveform analysis condition according to said refrigerating cycle state information, wherein when receiving said trigger, said waveform input means starts to retrieve said waveform data from said general-purpose network, said waveform analysis condition creating means notifies said waveform analysis condition to said trigger output means, said refrigerating cycle analyzing means extracts a time span having a high frequency changes in the state of said refrigerating cycle, and includes the time span in said refrigerating cycle state information, and said waveform analysis condition creating means creates said waveform analysis condition that said message information is obtained according to said message retrieved in said time span by said message analyzing means.

3. The air conditioning system diagnosis apparatus of claim 2, further comprising refrigerant system determining means for determining a correlation relation between said message information and said refrigerating cycle state information, wherein:

said storage means stores said message information and said refrigerating cycle state information, which are correlated by said refrigerant system determining means, as a set.

4. The air conditioning system diagnosis apparatus of claim 3, wherein:

said message analyzing means derives air conditioner data as at least a part of said message information, said air conditioner data being information used to identify one of said air conditioners, which is a transmission source or a transmission destination of said message; and said refrigerant system determining means has a refrigerant system determination table for storing a record, in which said air conditioner data and a refrigerant system ID indicating a refrigerant system to which said air conditioner belongs are correlated, extracts said refrigerant system ID when said refrigerant system determination table includes said refrigerant system ID correlated with said derived air conditioner data, and correlates said message information and said refrigerating cycle state information by using said refrigerant system ID.

5. The air conditioning system diagnosis apparatus of claim 4, wherein when said refrigerant system ID correlating with a part of said derived air conditioner data does not exist in said refrigerant system determination table, said refrigerant system determining means newly creates a record in which a refrigerant system ID correlating with another part of said derived air conditioner data, said refrigerant system ID of which exists, corresponding to the part and the each part of said derived air conditioner data, said correlated refrigerant system ID of which does not exist, are correlated and adds said record to said refrigerant system determination table.

6. The air conditioning system diagnosis apparatus of claim 4, wherein, when said refrigerant system ID correlated to every part of said derived air conditioner data does not exist in said refrigerant system determination table, said refrigerant system determining means creates a new refrigerant system ID, newly creates a record, in which said new refrigerant system ID and each part of said derived air conditioner data, said refrigerant system ID of which does not exist, are correlated, and adds the new record to said refrigerant system determination table.

7. The air conditioning system diagnosis apparatus of claim 2, wherein:

said message information includes a measured value of a sensor installed in said air conditioning system; and said refrigerating cycle analyzing means creates said refrigerating cycle state information indicating that said refrigerating cycle is abnormal when said measured value exceeds a predetermined abnormality threshold.

8. The air conditioning system diagnosis apparatus of claim 2, wherein said refrigerating cycle analyzing means has a normal template and an abnormal template for said message information, derives a similarity of said normal template and said abnormal template with a part or all of said message information, and creates said refrigerating cycle state information indicating that said refrigerating cycle is abnormal when said similarity with said abnormal template exceeds a predetermined threshold.

9. The air conditioning system diagnosis apparatus of claim 2, further comprising trigger output means that receives said message information from said message analyzing means and outputs a trigger to said waveform input means when said message information meets a waveform analysis condition, wherein said waveform input means has a buffer used to temporarily store said waveform data, retrieves said waveform data from said general-purpose network and stores said waveform data in said buffer before receiving said trigger from said trigger output means, and acquires said waveform data from said buffer when said waveform input means receives said trigger from said trigger output means.

10. The air conditioning system diagnosis apparatus of claim 2, wherein:

said waveform analysis condition is one of a plurality of waveform analysis conditions; and said waveform analysis condition is selectable.

11. The air conditioning system diagnosis apparatus of claim 2, wherein said waveform analysis condition creating means creates said waveform analysis condition that said message information has, as a transmission source or a transmission destination, an address belonging to a refrigerant system found to have an abnormality from said refrigerating cycle state information.

12. The air conditioning system diagnosis apparatus of claim 2, wherein said waveform analyzing means quantifies the degree of abnormality for each parameter representing the abnormality in said waveform data.

13. The air conditioning system diagnosis apparatus of claim 2, further comprising synchronization determining means for receiving said message information from said storage means and receiving said waveform information from said waveform analyzing means, wherein said synchronization determining means determines correlation relation between said message information and said waveform information and said storage means stores said message information and said waveform information, which are correlated by said synchronization determining means, as a set.

14. The air conditioning system diagnosis apparatus of claim 2, wherein when said message analyzing means analyzes the content of said message, a protocol to which the message to be analyzed belongs is made to be selectable.

15. The air conditioning system diagnosis apparatus of claim 2, wherein said refrigerating cycle analyzing means extracts a time span having a high frequency abnormality occurrence in said refrigerating cycle, and includes the time span in said refrigerating cycle state information, and said waveform analysis condition creating means creates said waveform analysis condition that said message information is obtained according to said message retrieved in said time span having a high frequency abnormality occurrence in said refrigerating cycle by said message analyzing means.

* * * * *